United States Patent [19]

Harris

[11] 4,274,489

[45] Jun. 23, 1981

[54] RETRIEVABLE BRIDGE PLUG AND METHOD OF SETTING

[75] Inventor: Monty E. Harris, Cleveland, Okla.

[73] Assignee: The Dow Chemical Company, Midland, Mich.

[21] Appl. No.: 47,401

[22] Filed: Jun. 11, 1979

[51] Int. Cl.[3] ..... E21B 23/06; E21B 33/129

[52] U.S. Cl. ..... 166/315; 166/139

[58] Field of Search ..... 166/315, 139

[56] References Cited

U.S. PATENT DOCUMENTS

| | | | |
|---|---|---|---|
| Re. 28,641 | 12/1975 | Chenoweth | 166/139 X |
| 3,279,542 | 10/1966 | Brown | 166/139 |
| 3,702,634 | 11/1972 | Anderson et al. | 166/315 |

*Primary Examiner*—Ernest R. Purser

*Attorney, Agent, or Firm*—V. Dean Clausen

[57] ABSTRACT

A bridge plug tool is disclosed, for temporarily plugging off a well casing to perform a downhole operation, such as cementing, or acidizing. The tool includes a mandrel having separate thread segments thereon. During running in of the tool, one thread segment engages a set of control members, to keep the mandrel in place and to prevent it from shifting longitudinally. In the set position the control members are disengaged from the mandrel, and the other thread segment engages a set of lock members. Setting weight on the mandrel after engagement with the lock members causes a set of slips and packing elements to engage the casing wall. When the downhole job is finished, the mandrel is rotated to disengage from the lock members and to re-engage the control members. This sequence releases the slips so the tool can be retrieved from the casing, or re-set at another point in the casing.

8 Claims, 2 Drawing Figures

RETRIEVABLE BRIDGE PLUG AND METHOD OF SETTING

BACKGROUND OF THE INVENTION

The invention relates broadly to a plug for temporarily plugging off a well casing. More specifically, the invention covers a packer-type bridge plug, which is retrievable from the well casing.

In the production of oil and gas there are various downhole operations which may require temporarily plugging off the well casing at a given point, or at more than one point. Examples of such operations are cementing of the annulus between the borehole and the well casing, hydraulic fracturing of a producing zone, or treating the zone with chemicals to consolidate loose sand.

The tools now available for plugging the well casing are not entirely satisfactory in that they are difficult to use and costly to maintain. For example, one of the commercially available plugging tools has an extremely complex structure which includes many parts. The complex structure and the number of parts makes it easy to overlook a defective part during reconditioning of the tool between operations. This same tool is built with a substantial number of O-ring seals, which adds to the problem of fluid leakage in a downhole tool.

SUMMARY OF THE INVENTION

The tool of this invention is a packer-type bridge plug useful for temporarily plugging off a well casing. Following performance of a downhole operation, the bridge plug can be retrieved from the well casing and reconditioned for further use. The basic tool comprises an elongate mandrel, which is enclosed by a group of upper and lower components to make up the complete tool. On the mandrel itself is an integral shoulder member and two separate thread segments.

The upper component group includes a coupling means, a cone member, and packing elements positioned between the coupling means and the cone member. In addition, the upper part of the tool has a packing sleeve which fastens into the coupling means, and a compression sleeve positioned between the packing sleeve and the mandrel. The lower components enclosing the mandrel include a set of lock members, a set of control members, and a retainer means for the lock members and control members. One of the thread segments on the mandrel is adapted to engage the lock members during one phase of the tool operation. During another phase of the tool operation, a second thread segment on the mandrel is adapted to engage the control members.

A set of slip members are mounted on the retainer means. These slip members are adapted to slide upwardly on the cone as the cone moves downwardly. Also mounted on the retainer means is a set of drag blocks. As the tool is lowered into the well casing, the drag blocks are adapted to push outwardly and drag against the inside of the well casing.

DESCRIPTION OF PREFERRED EMBODIMENTS

Figure 1:
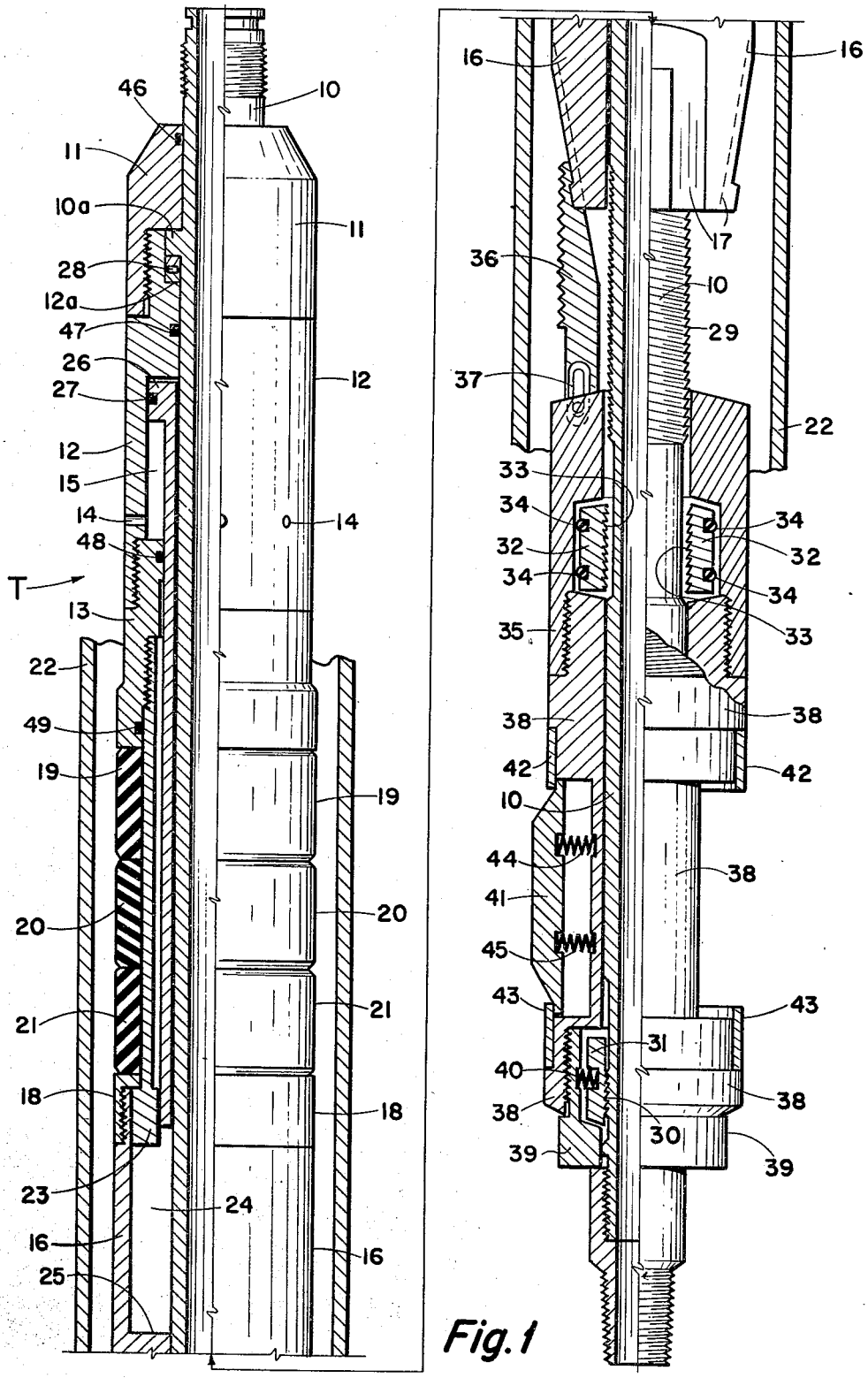
FIG. 1 is a two-part elevation view, partly in section, illustrating the bridge plug tool as it appears, both during run in and retrievel from the well casing.

In the drawing the letter T generally indicates the tool of this invention. The basic tool is made up of an elongate mandrel 10, which is enclosed by several other components generally referred to as upper components and lower components. Part of the upper component structure is defined by a coupling means, which includes, the top coupling 11, a center coupling 12, and a lower coupling 13. The top coupling 11 threads onto the top end of center coupling 12 and the lower coupling 13 threads into the bottom end of the center coupling 12.

The center coupling 12 has at least one vent opening 14 therein. In actual practice more than one vent opening may be used. The vent communicates with a space 15 defined between the center coupling 12 and mandrel 10. Near the center of the tool, the mandrel is enclosed by a cone 16. A group of four lengthwise slots 17 are machined into the outside surface of the cone 16.

A gauge ring 18 is threaded over the top end of cone 16. A group of three packing elements, a top element 19, center element 20, and bottom element 21, are sandwiched between the bottom edge of coupling 15 and the top edge of gauge ring 18. The packing elements are made of a hard rubber composition, with the top and bottom elements having the same hardness and the center element having a softer structure. The center element is made of a softer structure to enable the packing elements to compress sufficiently to form a good seal against the inside of the well casing 22, when the tool is put into its set position.

Figure 2:
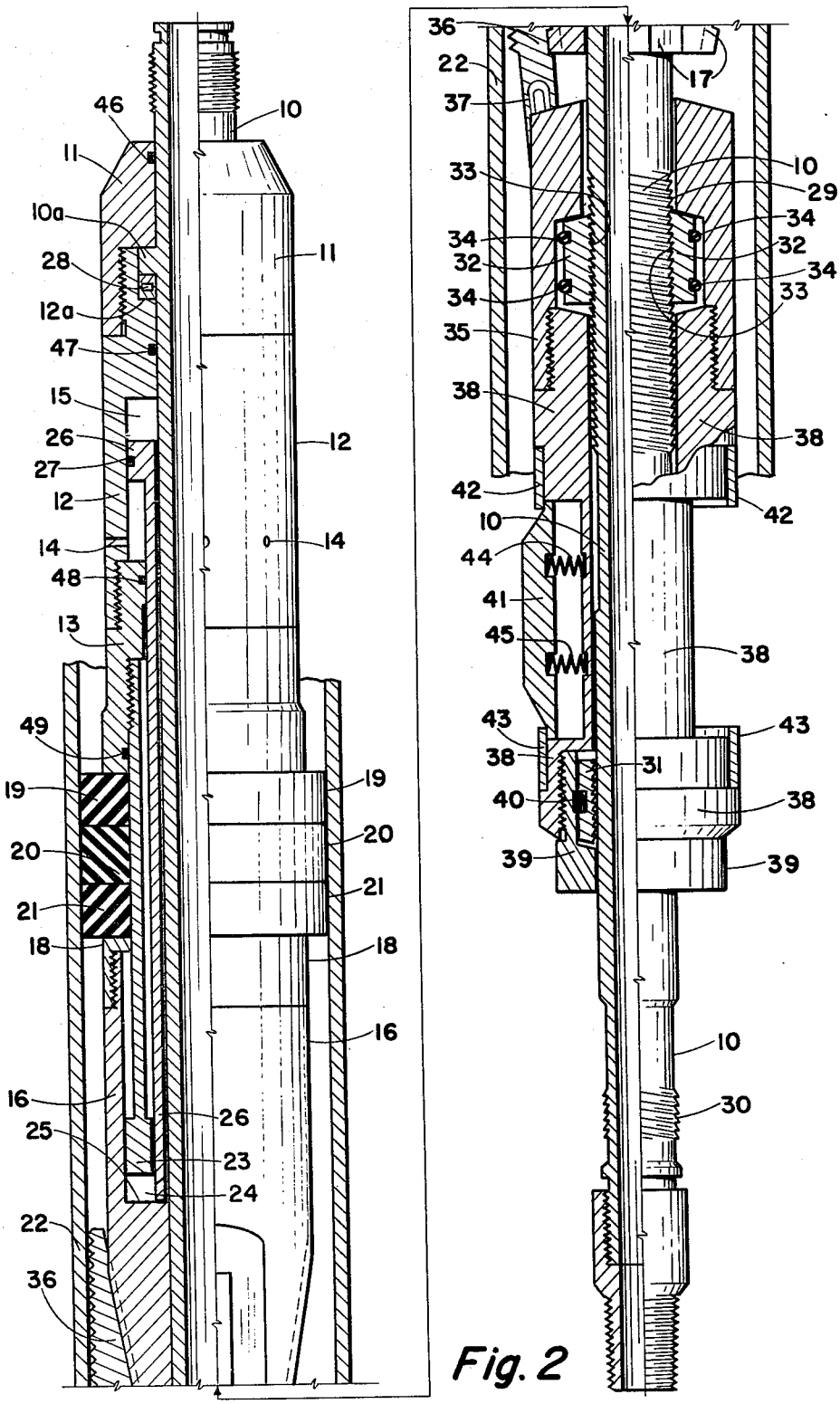
FIG. 2 is a two-part elevation view, partly in section, showing the bridge plug tool during its set position in the well casing.

The packing elements 19, 20, and 21 are held in place on the tool by a packing sleeve 23. The top end of sleeve 23 is threaded into the lower coupling 13, so that the sleeve remains fixed at the top end. The lower end of the packing sleeve 23 is slidable lengthwise within a space 24, the space being defined between cone 16 and mandrel 10. In FIG. 2 the tool is shown as it appears when in the set position. In this position the packing sleeve moves down to a position just above an inside shoulder 25 on cone 16. A compression sleeve 26 is positioned between the packing sleeve 23 and mandrel 10. The top end of sleeve 26 is defined by a head portion, similar to a piston head. An O-ring 27 in the head portion forms a seal with the inside wall of the center coupling 12.

Near the top end of mandrel 10 is an integral shoulder member 10*a*. A needle bearing assembly 28 is positioned between the mandrel shoulder and an inside shoulder 12*a* on coupling 12. The purpose of bearing 28 is to prevent excessive wear between the underside of the mandrel shoulder 10*a* and the inside shoulder 12*a* on coupling 12. Mandrel 10 also includes two integral separate thread segments, located toward the lower part of the mandrel. The first segment is a left-hand male thread, indicated by numeral 29. The second thread segment, indicated by numeral 30, is a right-hand male thread, positioned on the mandrel below the left-hand thread 29.

One of the lower components of the bridge plug tool is a set of four control members. Only one control member is shown in the drawing, as indicated by numeral 31. During the running in step, that is, when the tool is being lowered into the well casing 22, the right-hand male thread 30 engages corresponding female threads (not shown) on the control members 31. Another part of the lower component structure is provided by a set of four lock members. Only two of the lock members are shown in the drawing, as indicated by numeral 32. When the tool is put into the set position in the well casing, as described in more detail later, the left-hand male thread 29 on the mandrel is adapted to engage the corresponding female threads 33 on each of the lock members 32. During the running in of the tool, as illustrated in FIG. 1, the threads 29 are disengaged from the threads 33 on the lock members.

The lock members 32 are held against the mandrel 10 by a pair of garter springs 34. A housing 35, which encloses and retains the lock members 32, is another part of the lower component structure. A set of four slip members provides means for gripping the inside of the well casing 22. Only one of the slip members is shown in the drawing, as indicated by numeral 36. The bottom end of each slip member is secured to the lock member housing 35 by a link connector 37. Connector 37 allows each of the slip members to slide up and down in one of the lengthwise slots 17 on the outside surface of cone 16.

Other pieces of the lower component structure include a drag block housing 38 and a retainer collar 39. The drag block housing 38 fastens into the bottom end of the lock member housing 35, and collar 39 threads into the bottom end of the drag block housing. The combined structure of the housings 35 and 38 and collar 39 provide means for retaining the lock members 32 and control members 31. A coil spring 40 is fitted between the collar 39 and each control member 31, to hold the control member in contact with mandrel 10.

A set of four drag blocks provides means for centering the tool in the well casing 22. Only one of the drag blocks is shown in the drawing, as indicated by numeral 41. These blocks, which are always in contact with the casing wall during raising and lowering of the tool, also provide a means for resisting downward movement of the tool while it is in the set position (as shown in FIG. 2). The drag blocks 41 are held in place on housing 38 by an upper retainer ring 42 and a lower retainer ring 43. A pair of coil springs 44 and 45 are fitted between each drag block and the housing 38. These springs provide the bias force required to push the drag blocks outwardly against the well casing 22.

OPERATION

The invention can be illustrated by describing a typical operation in which the bridge plug tool is used to temporarily plug off a well casing. The mandrel 10 is connected into a transition piece at its upper end. In turn, the transition piece is connected into a J-slot bypass and a retrieving head. The retrieving head is then connected into the tubing string. The tubing string, retrieving head, the bypass and the transition piece are not shown in the drawing. The bridge plug tool is then lowered on the tubing string into the well casing 22, until it reaches the point where the casing is to be plugged off.

During this running in step it is critical that the mandrel 10 not be allowed to move either up or down within the tool structure. If the mandrel were allowed to shift during the running in step, it would assume a position in which the slips and the packing elements could not be actuated to engage the inside of the well casing.

To prevent a longitudinal shifting of the mandrel, the mandrel is put in a locked position during the running in step, as illustrated in FIG. 1. When the mandrel is in locked position, the threads 30 are in engagement with the corresponding threads on the control members 31. Also, the shoulder **10*a* at the top of the mandrel is locked between the top coupling 11 and the bearing assembly 28. When the tool reaches the desired point for plugging off the casing, the tool is put into a neutral position. This is done by rotating the mandrel clockwise until the right-hand threads 30 move down far enough to disengage from the corresponding right-hand threads on the control members 31. Following this step, the operator on the rig floor sets weight on the tubing string, to force the mandrel down several inches. Moving the mandrel down causes the left-hand threads 29, on the mandrel, to engage the left-hand threads 33 on the lock members 32**, by a racheting action.

As the mandrel 10 moves down, the lower coupling 13 pushes down on the packing elements 19, 20 and 21. The packing elements, in turn, force the cone 16 to move down. As the cone 16 moves down, the slips 36 ride upwardly in the slots 17 on the cone, which causes the slips to push outwardly and grip onto the well casing 22. When the slips bite into the casing wall, they prevent further downward movement of the cone. The packing elements are thus compressed between the lower coupling and the cone, so that they will expand lengthwise and seal against the casing wall. When the slips and the packing elements engage the casing wall, the tool is in its set position, as illustrated in FIG. 2.

The tool of this invention has a means for applying a positive downward force against the cone. This downward force prevents the slip members 36 from releasing and unloading the packing elements 19, 20 and 21, when the tool is in the set position. Most of this downward force is provided by the compression sleeve 26. When the bridge plug tool is in the set position, the lower end of the compression sleeve 26 is positioned a fraction of an inch above the inside shoulder 25 on cone 16. However, in the set position, the head portion at the top of compression sleeve 26 moves down only slightly within the space 15, which is defined between the center coupling 12 and lower coupling 13.

The function of compression sleeve 26 is to utilize the bottom hole fluid pressure as a reserve force to prevent the cone 16 from pushing outwardly and releasing the slip members 36. To explain further, the fluid below the packing elements (bottom hole fluid) pushes up against the lower packing element 21. When the fluid bumps against the packing element, it reverses and backflows through the restricted space defined between cone 16 and the mandrel, and between the compression sleeve 26 and the mandrel. When the upwardly moving fluid reaches the top of the compression sleeve, it pushes down on the flat face of the compression sleeve head, to force the lower end of the compression sleeve down against shoulder 25 on cone 16. The vent opening 14 in the center coupling 12 provides an outlet for the fluid which becomes trapped in space 15 as the compression sleeve moves down.

After the bridge plug tool has been set, to plug off the casing, the tubing string is disconnected from the tool, so that the desired downhole operation can be performed. When the job is finished, the tubing string is lowered into the casing until the retrieving head engages the J-slot bypass. The next step is to rotate the mandrel 10 in a clockwise direction. This causes the mandrel to move upwardly and disengage the left-hand threads 29 from the corresponding left-hand threads 33 on the lock members 32.

When the mandrel moves far enough, the right-hand threads 30 will engage the corresponding right-hand threads of the control members 31. This puts the mandrel back into its lock position so that it is secured against any longitudinal shift. The upward movement of the mandrel also allows the slip members 36 to slide downwardly on the cone 16 and release from the well casing 22. At the same time, the packing elements 19, 20 and 21 release from the well casing so that the tool can be either retrieved from the casing, or re-set at another point in the casing. During retrieval, the tool is once again in the position illustrated in FIG. 1.

The tool of this invention has certain features which give it a distinct advantage over many of the tools now used to plug off a casing. One of these features is that the present tool requires very few O-ring seals. These include O-ring seals 46 and 47, positioned between the mandrel 10 and couplings 11 and 12. Two other O-ring seals, 48 and 49, are positioned between the compression sleeve 26 and coupling 13, and between the packing sleeve 23 and coupling 13. A single O-ring 27, as described earlier, seals the compression sleeve against the inside wall of coupling 12.

The gauge ring 18 also provides another mechanical feature which permits using packing elements in different sizes on the same bridge plug tool. This is done by providing gauge rings of different sizes, each ring being designed to accommodate packing of a specific size. The use of interchangeable gauge rings, therefore, enables the tool to be used in casings of different sizes without the inconvenience of having to assemble a "new" tool each time.

Another mechanical feature is a means for connecting the bridge plug tool, through the tubing string, to a weight indicator on the rig floor. The weight indicator allows the operator on the rig floor to determine at all times where the tool is located in the well casing, and whether the tool is in the set position, or the neutral position.

What is claimed is:

1. A bridge plug tool capable of plugging off a well casing and thereafter being retrieved from the well casing, the tool comprising:

an elongate mandrel which includes a shoulder member, a first thread segment, and a second thread segment;

the mandrel being enclosed by upper components which include a coupling means, a cone member, packing elements positioned between the coupling means and the cone member, a packing sleeve which fastens into the coupling means, and a compression sleeve positioned between the packing sleeve and the mandrel;

the mandrel being enclosed by lower components which include a set of lock members engageable with the first thread segment on the mandrel, a set of control members engageable with the second thread segment on the mandrel, and retainer means for retaining the lock members and the control members in place on the tool;

a set of slip members mounted on the retainer means, and adapted to slide upwardly on the cone member during downward movement of the cone; and a set of drag blocks mounted on the retainer means, and adapted to push outwardly against the inside of the well casing when the tool is lowered into said casing.

2. The tool of claim 1 in which the first thread segment on the mandrel is a left hand thread, and each locking member has a left hand thread engageable with the first thread segment on the mandrel.

3. The tool of claim 1 in which the second thread segment on the mandrel is a right hand thread, and each control member has a right hand thread engageable with the second thread segment on the mandrel.

4. The tool of claim 1 which further includes a means which connects the tool, while being lowered in the well casing, to a weight indicator on the earth's surface.

5. The tool of claim 1 which further includes a bearing means, the bearing being positioned between the mandrel shoulder and a shoulder defined on the coupling means.

6. The tool of claim 1 in which the compression sleeve is slidable lengthwise in a space generally defined between the mandrel and the cone member, packing sleeve, and coupling means.

7. Method for plugging off a well casing with a bridge plug tool, the tool including an elongate mandrel having a first thread segment, and a second thread segment thereon, the first thread segment being engageable with a set of lock members on the tool, and the second thread segment being engageable with a set of control members on the tool, the method comprising:

running the tool into the casing to a desired point for plugging off the casing;

positioning the mandrel during the run-in, such that the first thread segment is disengaged from the lock members, and the second thread segment is fully engaged with the control members;

rotating the mandrel several turns, to cause the mandrel to move downwardly and disengage the mandrel from the control members;

setting weight on the mandrel from above the tool, to cause the mandrel to move further downwardly and engage the first thread segment on the mandrel with the lock members;

forcing a cone member on the tool downwardly against a set of slip members, to cause the slip members to move outwardly and set against the inside wall of the casing; and compressing a set of packing elements between the cone member and a coupling member on the tool, to cause the elements to expand and set against the inside wall of the casing.

8. The method of claim 7 which further comprises the steps of:

rotating the mandrel several turns, to cause the mandrel to move upwardly and disengage the first thread segment from the lock members, and to engage the second thread segment with the control members;

causing a sleeve member in the tool to engage the cone member and pull it upwardly;

allowing the slip members to slide downwardly on the cone member and thereby release from the casing wall;

causing the coupling member on the tool to move upwardly by engagement with a shoulder member on the mandrel, to retract the packing members and release said packing members from the casing wall; and pulling the tool out of the well casing.

* * * * *